US008257134B2

(12) United States Patent
Zuloff

(10) Patent No.: US 8,257,134 B2
(45) Date of Patent: Sep. 4, 2012

(54) GAME DEVICE AND METHOD THEREOF

(76) Inventor: Steve Zuloff, Los Angeles County, CA (US)

( * ) Notice: Subject to any disclaimer, the term of this patent is extended or adjusted under 35 U.S.C. 154(b) by 370 days.

(21) Appl. No.: 12/657,312

(22) Filed: Jan. 19, 2010

(65) Prior Publication Data

US 2011/0177749 A1 Jul. 21, 2011

(51) Int. Cl.
*A63H 3/06* (2006.01)

(52) U.S. Cl. ..... 446/220; 446/473; 42/58; 124/37

(58) Field of Classification Search ..... 446/220, 446/473, 221–226, 405–407, 177; 273/458, 273/461; 42/54–58; 124/27, 31, 37
See application file for complete search history.

(56) References Cited

U.S. PATENT DOCUMENTS

| | | | | | |
|---|---|---|---|---|---|
| 2,749,727 | A * | 6/1956 | Fabro | ..... | 215/236 |
| 3,204,369 | A * | 9/1965 | Green | ..... | 446/177 |
| 3,608,903 | A * | 9/1971 | Cooper et al. | ..... | 273/282.1 |
| 3,685,825 | A * | 8/1972 | Dorazio | ..... | 273/458 |
| 3,795,400 | A * | 3/1974 | Glass et al. | ..... | 273/458 |
| 3,861,684 | A * | 1/1975 | Gastin et al. | ..... | 273/287 |
| 4,113,261 | A * | 9/1978 | Sims et al. | ..... | 273/249 |
| 4,169,593 | A * | 10/1979 | Wood | ..... | 273/458 |
| 4,826,161 | A * | 5/1989 | Rookmaaker | ..... | 273/458 |
| 4,900,020 | A * | 2/1990 | Rehkemper et al. | ..... | 273/458 |
| 6,402,582 | B1 * | 6/2002 | Sherer | ..... | 446/220 |
| 7,134,665 | B2 * | 11/2006 | Holsten et al. | ..... | 273/458 |
| 2010/0267309 | A1 * | 10/2010 | Hyland | ..... | 446/188 |

OTHER PUBLICATIONS

Sullivan, "Do It Nicky!", Aug. 26, 2002, http://cleverninja.com/?m=200208, 3 pages.*

WWW.COATED.COM; Russian Roulette Balloon Gun Game, Coolest Gadget Reviews; www.coated.com/russian-roulette-ballon-gun-game/ ( 2 pages).

* cited by examiner

*Primary Examiner* — Gene Kim
*Assistant Examiner* — Matthew B Stanczak
(74) *Attorney, Agent, or Firm* — Howard C. Miskin, Esq.; Gloria Tsui-Yip, Esq.

(57) ABSTRACT

A game device that safely emulates a game of Russian Roulette using balloons and the method thereof. The game device resembles a revolver, but without a barrel, and with the muzzle adjacent the cylinder. The game device contains a protected pin instead of a bullet for puncturing a balloon. An expandable ring is rotatably mounted adjacent the muzzle of the device that allows exposure of the pin only when a fully blown balloon is positioned therein to be punctured. Upon actuation of the pin, it is only exposed for a very short period of time to further prevent unnecessary exposure and injury to the user.

18 Claims, 9 Drawing Sheets

GAME DEVICE AND METHOD THEREOF

FIELD OF THE INVENTION

The invention relates to a game device that safely emulates a game of Russian Roulette using balloons and the method thereof. In particular, a game device that resembles a revolver that contains a protected pin instead of a bullet for puncturing a balloon in a game of Russian Roulette.

BACKGROUND OF THE INVENTION

Russian Roulette is a lethal game of chance involving the use of a revolver. A single bullet is placed in the revolver, and each participant of the game takes turn to place the muzzle against his/her head and pulls the trigger. There are different methods of playing Russian Roulette. One method is that each participant gets to spin the cylinder that contains the one bullet before pulling the trigger, such that each player has an equal chance of discharging the bullet. Another method is that the cylinder does not get reset after each participant, and the chance of discharging the bullet increases with each subsequent participant.

Due to the lethal nature of Russian Roulette, it is not a popular game. An entertaining variation of the Russian Roulette using balloons was previously marketed. This prior art variation includes a device that resembles a revolver, but without the barrel. The muzzle of this device is adjacent the cylinder. Instead of using a bullet, a spring loaded pin is located in one of the chamber of the cylinder. A rigid plastic ring having a tab is removably and frictionally held on top of the device adjacent the muzzle, with the plane of the plastic ring in a horizontal position. A balloon is blown in the center of the plastic ring such that when the balloon exceeds the diameter of the ring, it is snuggly fitted and held by the ring. When the hammer hits the chamber containing the pin, the pin extends beyond the chamber to puncture the balloon held by the ring in front of the muzzle. A player can place the balloon adjacent his/her head or ear to make the game more exciting. This prior art variation has a number of disadvantages. First, with the pin located within the cylinder, a player can easily spot the chamber containing the pin (taking the fun out of the game). Second, after the pin punctures the balloon, the pin remains extending until the hammer is cocked to rotate the cylinder. The extended pin can easily injure a player. Finally, the plastic ring is easily disengaged from the top of the device, disrupting the momentum of the game.

Therefore, there is a need for an improved game device that safely emulates the game of Russian Roulette by providing a device that resembles a revolver and having a protected pin and a rotatably mounted ring that does not dislodge easily.

SUMMARY OF THE INVENTION

The present invention provides a game device for safely playing a game of Russian Roulette with balloons instead of bullets.

The game device of the present invention resembles a revolver, but without a barrel, and with the muzzle adjacent the cylinder. An expandable ring is rotatably mounted adjacent the muzzle of device allows exposure of the pin only when a fully blown balloon is positioned therein to be punctured.

The game device of the present invention comprises a main body that resembles a revolver without a barrel and an expandable ring mounted on the main body. The main body comprises a handle, a rotatably mounted cylinder, and a firing mechanism that are similar to and operate the same way as those components of a revolver. Instead of placing bullets in the chambers of the cylinder, a spring loaded piston is positioned in one of the chambers of the cylinder. A spring loaded pin is positioned outside and adjacent the cylinder and cooperates with the spring loaded piston. The expandable ring is rotatably attached to and positioned adjacent the muzzle of the main body for receiving a balloon to be blown therebetween. The expandable ring has at least one pin protection member that is positioned adjacent the muzzle to conceal the pin if no balloon is positioned between the ring. When a balloon is blown and positioned between the ring, the ring expands and the pin protection member is displaced from its original position concealing the pin to allowing the exposure of the pin.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
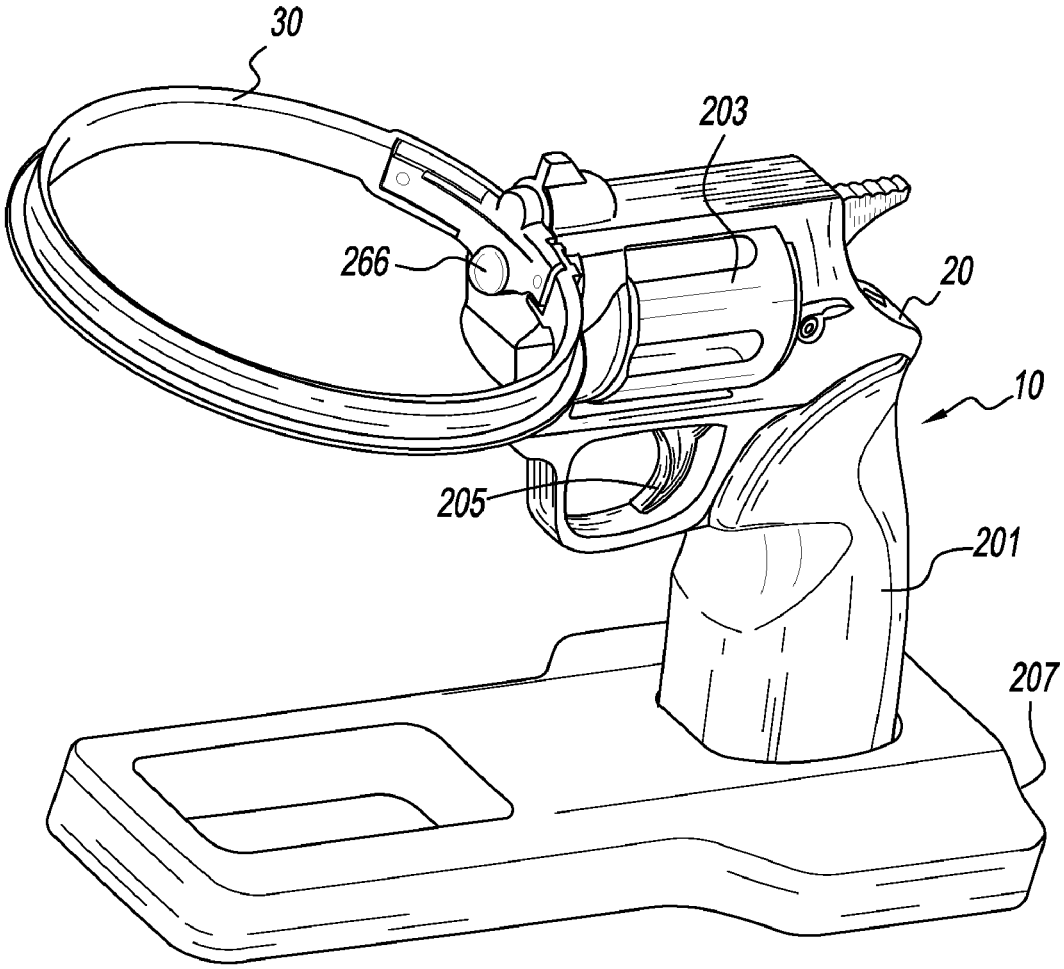
FIG. 1 is a perspective view of the game device of the present invention removably positioned on a base.
Figure 2:
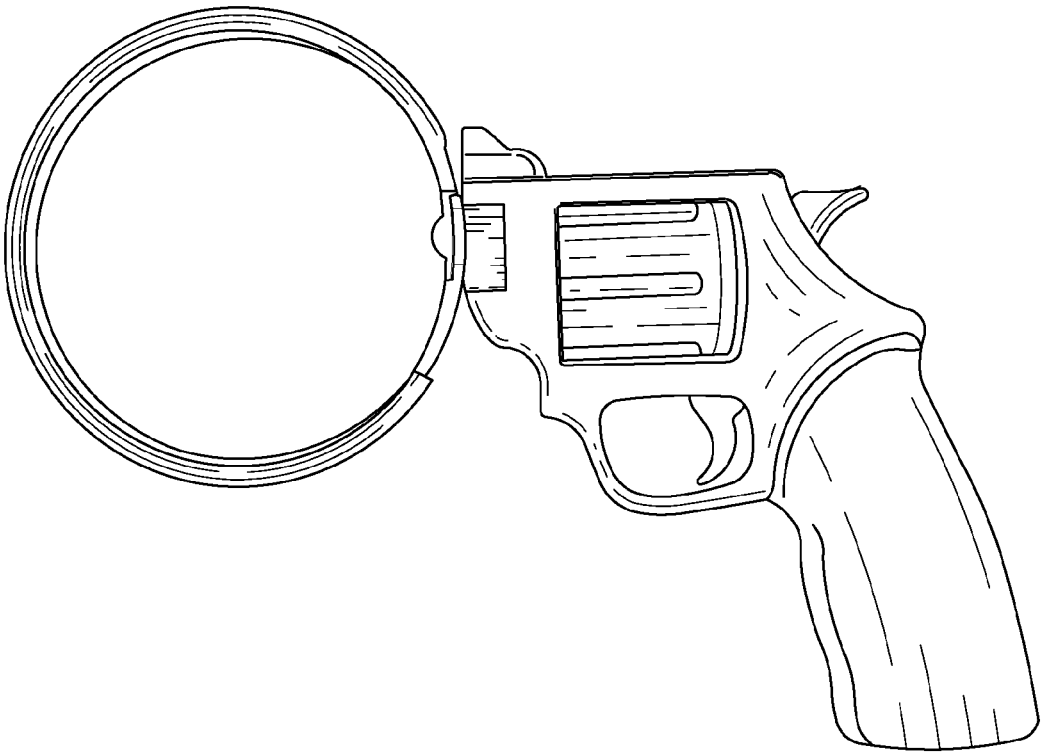
FIG. 2 is side view of the game device, with the expandable ring rotated ninety degrees.

With reference to the drawings, wherein the same reference number indicates the same element throughout, there is shown in FIGS. 1-2 a game device 10 of the present invention. The game device 10 comprises a main body 20 that resembles a revolver without a barrel, and an expandable ring 30 attached to the main body 20.

As shown in FIGS. 1-6, the main body 20 comprises a handle 201, a rotatably mounted cylinder 203, and a firing mechanism 205 that are similar to and operate the same way as those components of a revolver. The main body 20 may be formed from two substantially equal, but corresponding, halves 21*a* and 22*b*. The two halves 21*a* and 21*b* provide for axial rotatable support to the cylinder 203 and enclose the firing mechanism 205.

The handle 201 allows a user to comfortably grip the game device 10. The handle 201 can be optionally and removably mounted on a corresponding configured support base 207 to allow the game device 10 to be in an upright position for use, play or display. As shown in FIGS. 1, 3, 4 and 6, a spring loaded button 202 cooperates with a depression 204 on the support base 207 for the removable attachment.

The cylinder 203 has a plurality of cylindrical chambers 209 evenly distributed around the central axis of the cylinder 203. There can be any number of cylindrical chambers 209, such as five, six, seven, or more cylindrical chambers 209. The cylinder 203 is axially rotatable around its central axis about the main body 20.

The firing mechanism 205 comprises a hammer 211, a trigger 213, a pawl 215, a ratchet wheel 217, first spring 219 and second spring 221. The ratchet wheel 217 has a disk shape body 225 with a plurality of openings 227 that correspond to the cylindrical chambers 209 of cylinder 203, a pair of arms 218 extending from the inner planar surface and a plurality of teeth 223 on its outer planar surface. Each tooth 223 has a sloped side and a straight side. The ratchet wheel 217 is mounted onto one end of the cylinder 203 with the openings 227 in alignment with the chambers 209.

Figure 5:
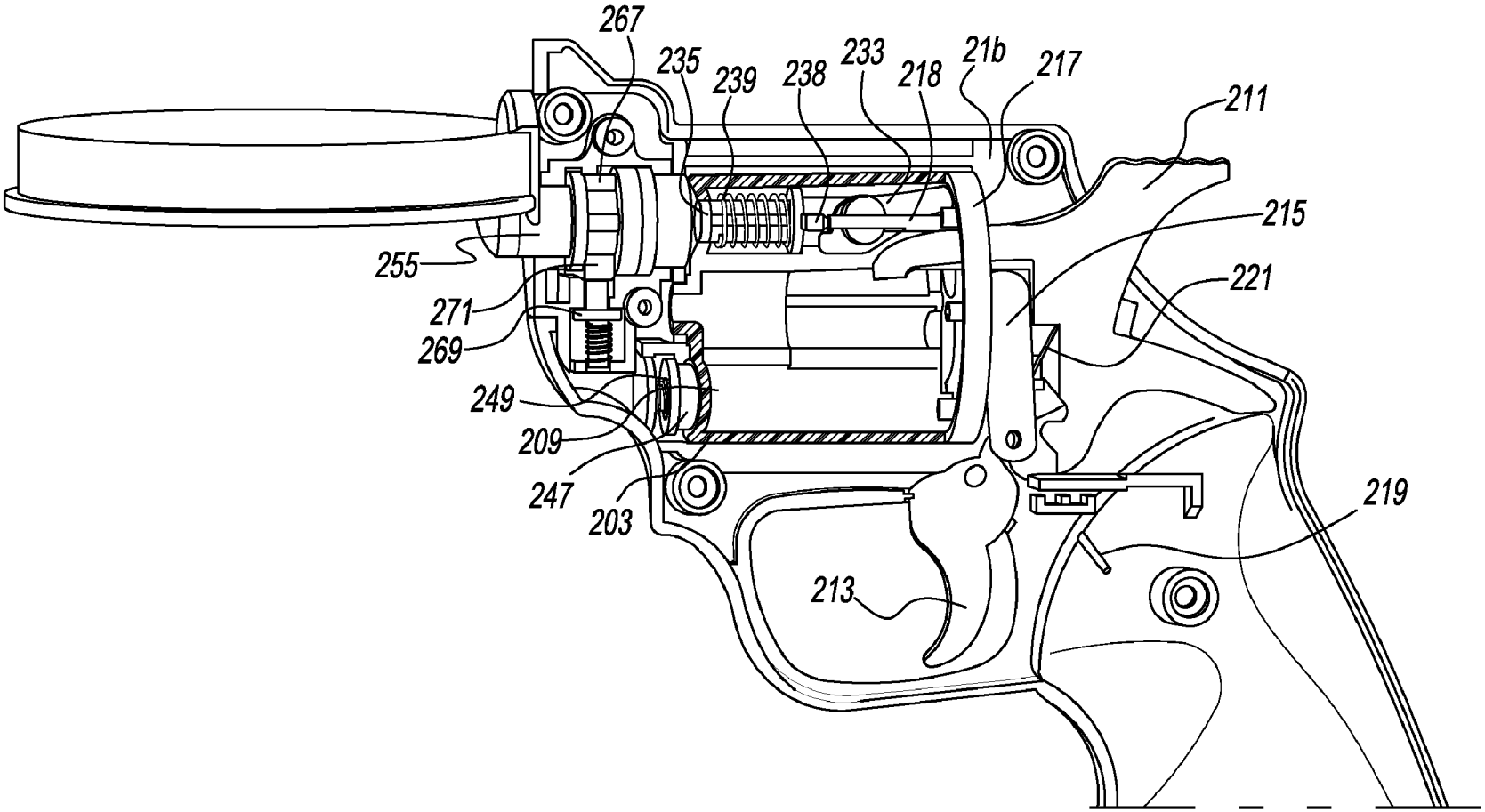
FIG. 5 is an enlarged view of the firing mechanism of the present invention with half of the main body removed.
Figure 6:
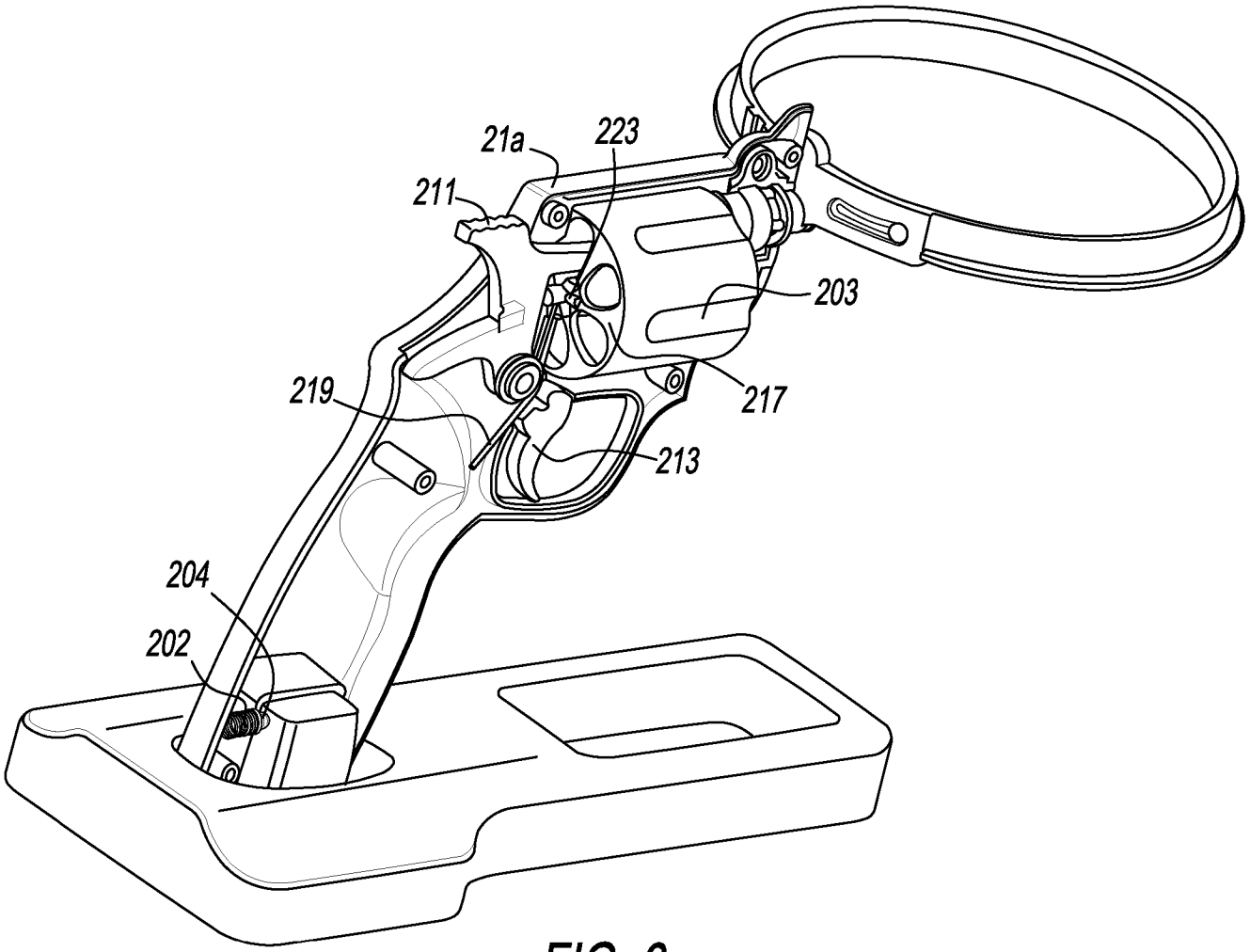
FIG. 6 is another view of the firing mechanism of the present invention similar to FIG. 5, but with the other half of the main body removed.

As shown in FIGS. 5 (with half 21*a* of the main body 20 removed) and 6 (with half 21*b* of the main body 20 removed), the hammer 211, trigger 213, pawl 215, ratchet wheel 217, first and second springs 219 and 221 are mounted on the main body 20 and interact and work cooperatively to function like a revolver, as known to one skilled in the art. When the hammer 211 is cocked, the pawl 215 is raised, interacting with the teeth 223 of the ratchet wheel and causing the ratchet wheel 217 (thus the cylinder 203) to rotate to the next chamber 209, and readying the trigger 213. When the trigger 213 is pulled, the hammer 211 is released, causing it to strike the space or a spring loaded piston 229 (to be described below) in a chamber 209 of the cylinder 203 that is in alignment. In the main body 20, a dome shape element 247 sized to engage one end of the chamber 209 cooperates with a spring 249 to keep the cylinder 203 from freely rotating about the main body 20 and to allow the indexing of each chamber 209 each time the hammer 211 is pulled.

Figure 3:
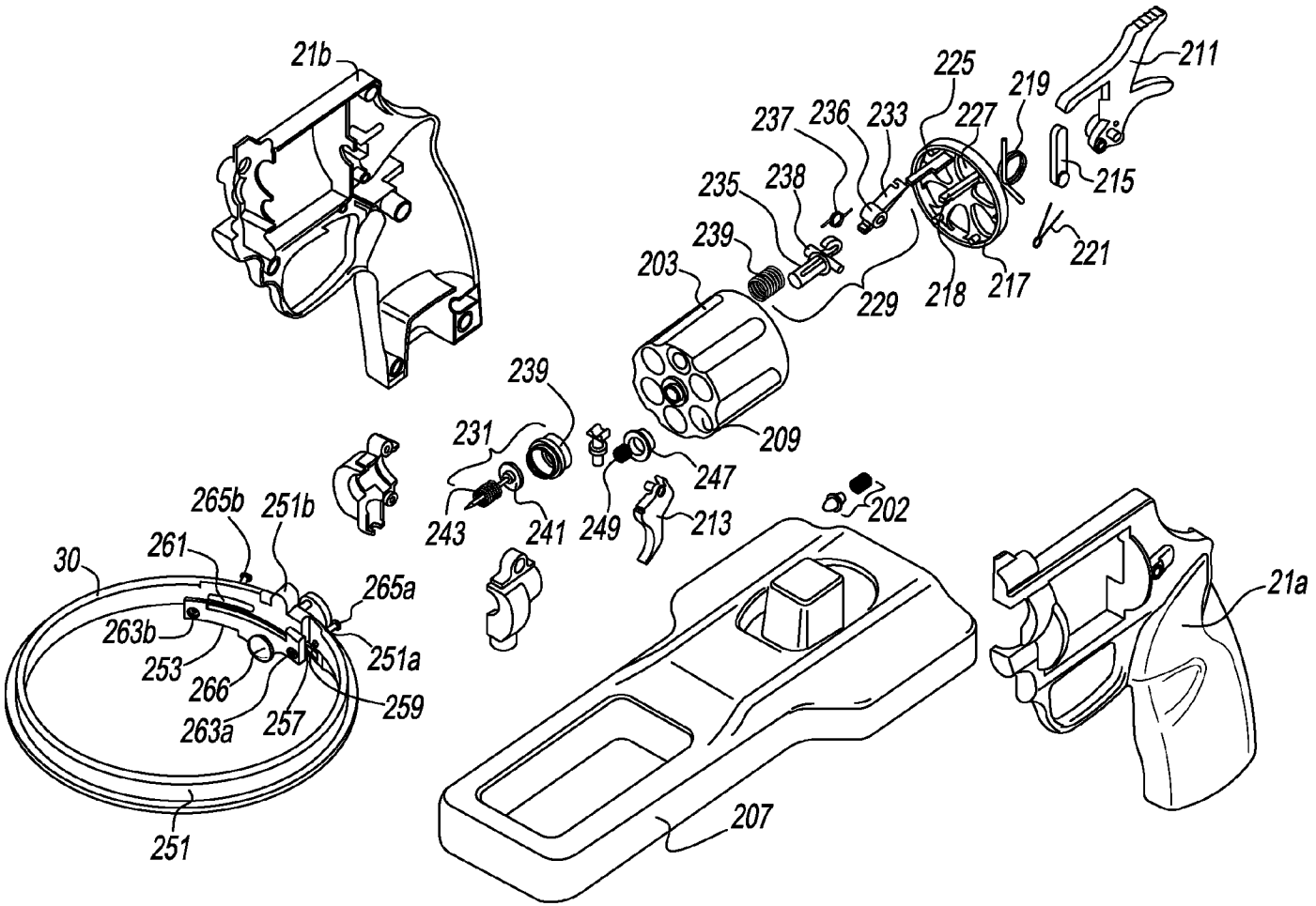
FIG. 3 is an exploded view showing the components of the game device of the present invention.
Figure 4:
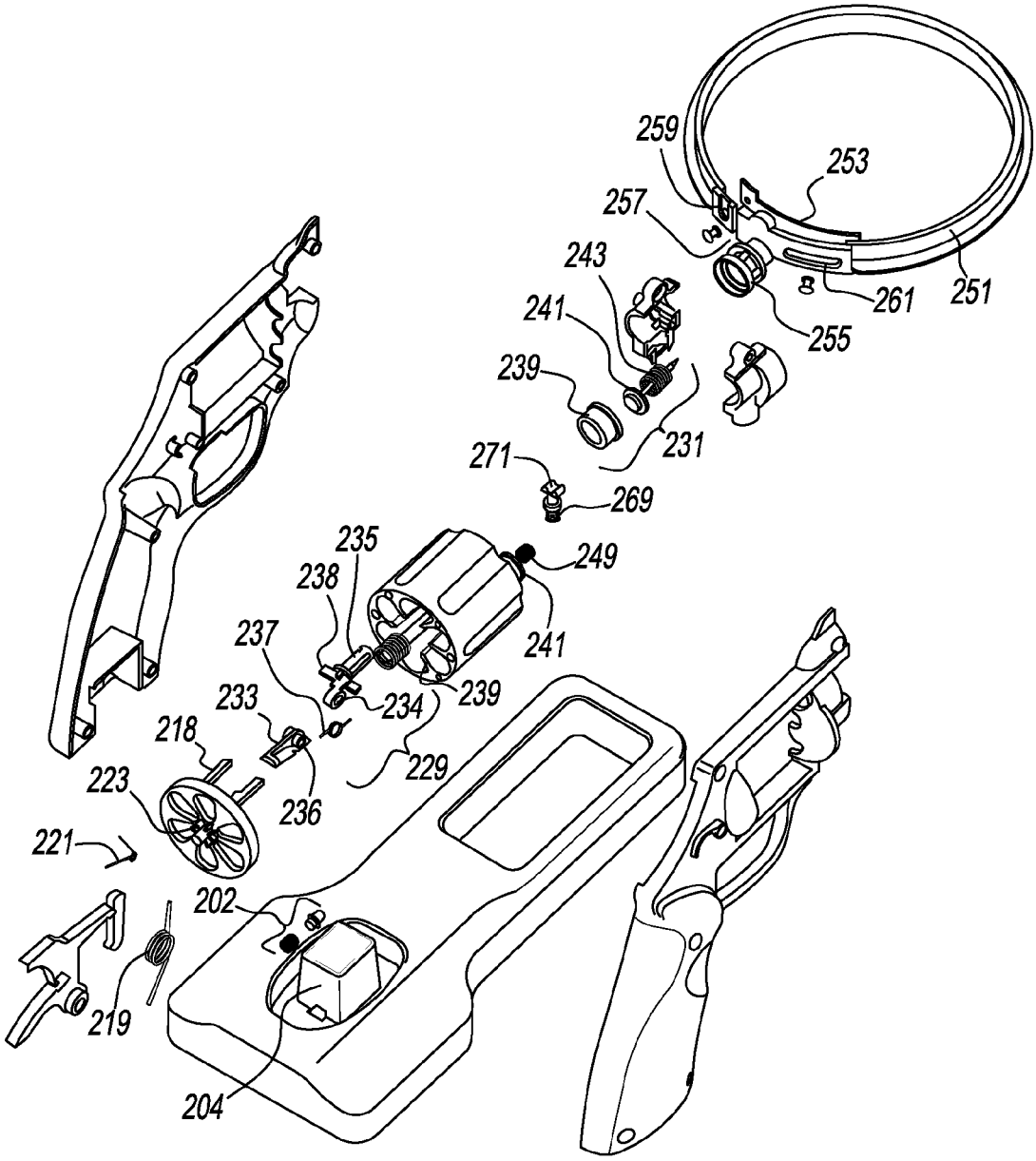
FIG. 4 is another exploded view showing the components of the game device of the present invention.

As shown in FIGS. 3-5, instead of placing bullets in the chambers 209 of the cylinder 203, a spring loaded piston 229 is placed in one of the chambers 209 and enclosed by the ratchet wheel 217 at one end. The spring loaded piston 229 cooperates and interacts with a spring loaded pin 231 that is placed adjacent the cylinder 203 within the main body 20.

The spring loaded piston 229 includes a striking element 233 pivotably connected to a piston element 235 with a spring 237 via a tubular opening 234 and a corresponding cylinder extension 236. A coil spring 239 overlays the cylindrical portion of the piston element 235 to keep the piston element 235 within the chamber 209 and to allow the piston element 235 to exit the chamber 209 in response to a force applied to it via the hammer 211 by compressing the spring 239. The traverse bar 238 slides along a pair of axially aligned and opposing grooves 210 (not shown) in the chamber 209 of cylinder 203. The spring loaded piston 229 is prevented from sliding out of the chamber 209 when arms 218 of the ratchet wheel come into contact with the traverse bar 238 of the piston element 235. The spring loaded pin 231 includes a pin housing 239 encircling a pin element 241 and a spring 243.

Figure 7:
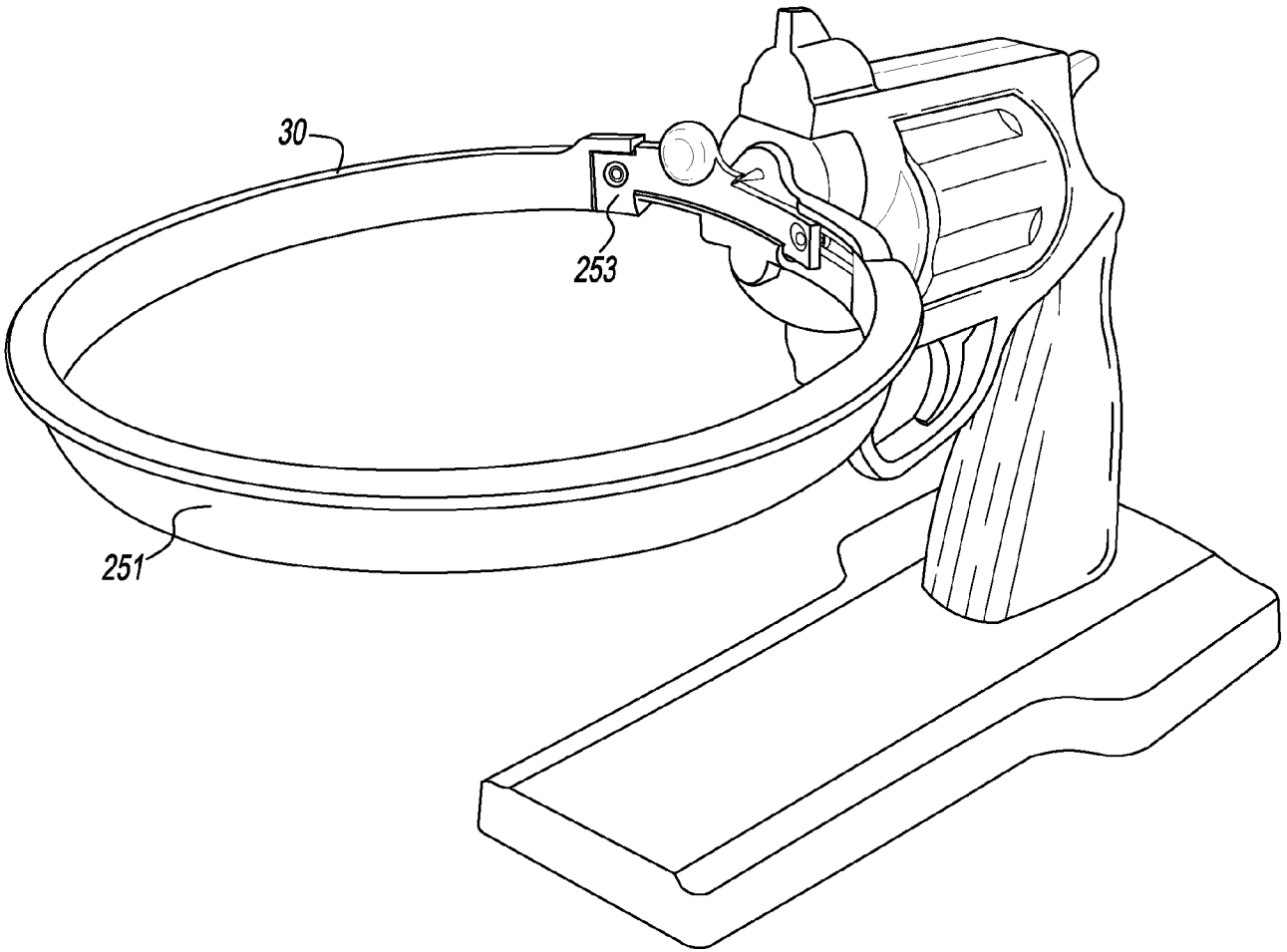
FIG. 7 is a view of the expandable ring in an expanded position if a balloon is blown therebetween (balloon not shown) and with the pin element exposed.
Figure 8:
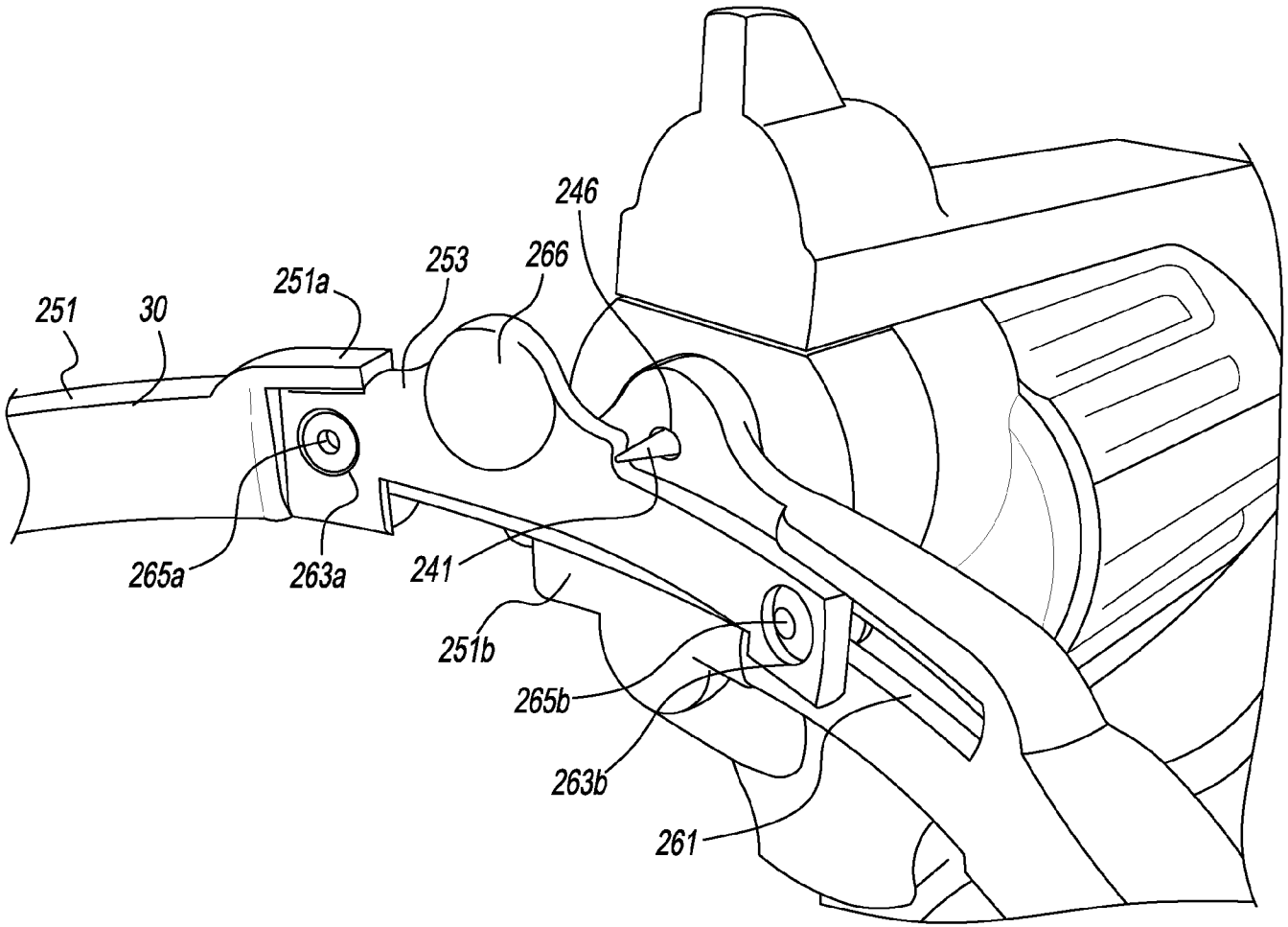
FIG. 8 is an enlarged view of FIG. 7.
Figure 9:
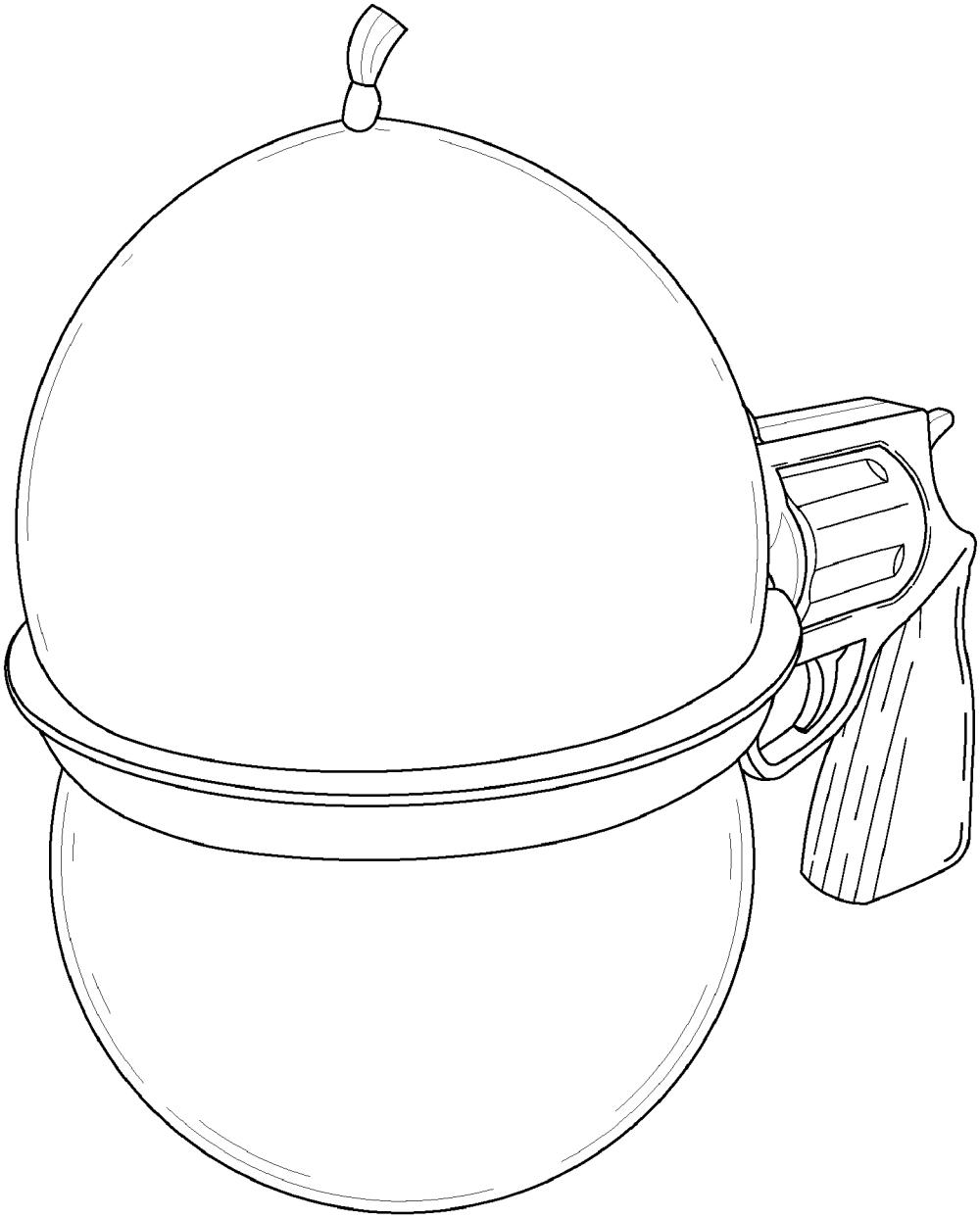
FIG. 9 is a view similar to FIG. 7, but showing a balloon in the expandable ring.

As shown in FIGS. 3, 4, 5, 7, 8, and 9, expandable ring 30 comprises a non-continuous circular frame member 251 and a frame expander member 253. The frame member 251 is discontinuous at a break 257, defining a first end 251*a* and second end 251*b*. Adjacent the first end 251*a* of the frame member 251 is an aperture 259. Adjacent the second end 251*b* of the frame member 251 is a slot opening 261. Between second end 251*b* and the slot opening 261 is a pinhole opening 246 and radially extending away from the frame member 251 opposite the pinhole opening 246 is a hollow tube 255 whose axis is in alignment with the pinhole opening 246. The pinhole opening 246 essentially acts as the muzzle of the game device 10. The space within the hollow tube 255 receives the spring loaded pin 231 such that pin element 241 is extendable through the pinhole opening 246 (as shown in FIGS. 7 and 8). The outer surface of the hollow tube 255 has a plurality of depressions 267 which cooperates with a spring loaded plunger 269. The seat 271 of the plunger 269 is pushed against the depression 267 to allow indexed rotation of the hollow tube 255 (and thereby rotation of the expandable 30) relative to the main body 20. The hollow tube 255, with the spring loaded pin 231, and the plunger 269 are safely enclosed within a cover 245 within the body 20. The frame expander member 253 has two small openings 263*a* and 263*b*, corresponding to aperture 259 and slot opening 261, respectively. Fastener 265*a* attaches the frame expander member 253 to frame member 251 through aperture 259 and opening 263*a*. Fastener 265*b* attaches the frame expander member 253 to frame member 251 through slot opening 261 and opening 263*b*. Frame expander member 253 has a pin protection member 266. The expandable ring 30 can be rotated to be in a planar vertical position, as shown in FIG. 2, for shipping and storage.

With the expandable ring 30 attached to the main body 20 as discussed above, in the at rest position (contracted position), the perimeter of the expandable ring 30 is formed with the frame member 251, with no space at the break 257, and the' frame expander member 253 overlapping the frame member 251 (see FIG. 1). At this position, the pin protection member 266 overlays and conceals the pinhole opening 246. With the presence of a blown balloon within the expandable ring 30, fastener 265*b* moves along slot opening 261 such that the perimeter of the expandable ring 30 is formed with the frame member 251 and the frame expander member 253, with a spacing at the break 257 (see FIGS. 7 and 8); thereby exposing the pinhole opening 246.

To safely play a game of Russian Roulette with the game device 10 of the present invention, a balloon is positioned between the expandable ring 30. The balloon is blown until it is large enough to cause the expandable ring 30 to expand to displace the pin protection member 266 to expose the pinhole opening 246. The hammer 211 is cocked, raising the pawl 215 to rotate the ratchet wheel 217 (and thereby the cylinder 203) to the next chamber 209, and readying the trigger 213. Assuming the chamber 209 that is in alignment contains the spring loaded piston 229, when the trigger 213 is pulled, the hammer 211 is released, causing it to strike the striking element 233 of the spring loaded piston 229 in a forward and downward direction. The striking element 233 is pushed forward, which in turn pushes the piston element 235 forward, which in turn pushes the pin element 241 forward through the pinhole opening 246 to puncture the balloon present in the expandable ring 30. With a burst balloon, the expandable ring automatically returns to its at rest (i.e. contracted) position such that the pin protection member 266 cover the pinhole opening 246 again to prevent the unnecessary exposure of the pin element 241.

Immediately after the hammer 211 pushes the striking element 233 forward, the striking element 233 pivots with respect to the piston element 235 to provide clearance to the downward moving hammer 211 to rest as shown in FIG. 5, to prevent the pin element 241 from being continuously exposed at the pinhole opening 246 until the hammer 211 strikes again. Therefore, the pin element 241 is exposed only for fractions of a second, just long enough to puncture a blown balloon placed within the expandable ring 30. This is an additional safety feature that prevents the unnecessary exposure of the pin element 241.

The features of the invention illustrated and described herein are the preferred embodiments. Therefore, it is understood that the appended claims are intended to cover the variations disclosed and unforeseeable embodiments with insubstantial differences that are within the spirit of the claims.

What I claim is:

1. A device for playing a game of Russian Roulette using balloons, comprising:

a. a main body having a rotatably mounted cylinder and a firing mechanism;

b. a spring loaded piston positioned within said cylinder;

c. a spring loaded pin positioned within said main body and outside said cylinder; and d. an expandable ring attached to said main body adapted to receive a balloon blown within said ring having a pinhole opening and a pin protection member, both of which are in alignment with said spring loaded pin, said pin protection member conceals said pinhole opening in the absence of a blown balloon and exposes said pinhole opening in the presence of a blown balloon;

wherein said firing mechanism selectively interacts and cooperates with said spring loaded piston in said cylinder, said spring loaded piston interacts and cooperates with and actuate said spring loaded pin, and when actuated said spring loaded pin passes through said pinhole opening of said expandable ring; and upon actuation of said firing mechanism in the presence of a blown balloon, said firing mechanism, when in alignment with said spring loaded piston, applies a force to said spring loaded piston, which force actuates said spring loaded pin to cause said spring loaded pin to pass through said pinhole opening to puncture said balloon.

2. The device of claim 1, wherein said main body having a shape similar to a revolver with a handle and a muzzle and without a barrel, and said expandable ring being rotatably attachable to said main body adjacent the muzzle.

3. The device of claim 1, wherein said firing mechanism comprises a hammer, a trigger, a pawl, a ratchet wheel, a first spring and a second spring that cooperate and interact with each other as in a revolver, and upon actuating said trigger to actuate said firing mechanism, said hammer applies said force to said spring loaded piston.

4. The device of claim 1, wherein said cylinder having a plurality of cylindrical chambers distributed around the axis of said cylinder and said spring loaded piston is positioned in one of said cylindrical chambers.

5. The device of claim 4, wherein said spring loaded piston comprises a striking element having an extension, a piston element having an opening correspondingly and pivotably connected to said extension, a spring cooperatively connecting said striking element and said piston element, and a coil spring overlaying said piston element, said coil spring interacts with one of said cylindrical chambers to keep said spring loaded piston within said chamber and to allow said spring loaded piston to exit said chamber to actuate said spring loaded pin in response to a force applied to said striking element by said firing mechanism.

6. The device of claim 1 wherein said expandable ring comprises a non-continuous circular frame member and a frame expander member, said frame member and said frame expander member forming a ring shape.

7. The device of claim 6 wherein said frame member having a first end and a second end, an aperture adjacent said first end and a slot opening adjacent said second end, and said frame expander member having opposite ends, a small opening adjacent each opposite end, and said pinhole opening being positioned between said second end and said slot opening, further comprising: a first fastener connecting said frame expander member to said frame member through one of said small opening and said aperture, and a second fastener connecting said frame expander member to said frame member through the other of said small opening and said slot opening.

8. The device of claim 1 wherein said expandable ring further having a hollow tube radially extending from said frame member for receiving said spring loaded pin therein.

9. The device of claim 8 wherein said hollow tube having an outer surface with a plurality of depressions, further comprising a spring loaded plunger having a seat, said seat being springingly pushed against said depressions to allow the indexed rotation of said hollow tube with respect to said main body.

10. A method of playing a game of Russian Roulette using balloons, comprising the steps of:

a. providing a main body having a rotatably mounted cylinder and a firing mechanism;

b. providing a spring loaded piston within said cylinder in alignment with said firing mechanism;

c. providing a spring loaded pin within said main body and outside said cylinder in alignment with said spring loaded piston;

d. providing an expandable ring attached to said main body having a pinhole opening and a pin protection member, both of which are in alignment with said spring loaded pin, said pin protection member conceals said pinhole opening in the absence of a blown balloon and exposes said pinhole opening in the presence of a blown balloon;

e. blowing a balloon within said expandable ring exposing said pinhole opening;

f. actuating the firing mechanism;

g. applying a force to said spring loaded piston by said actuated firing mechanism;

h. applying a force to said spring loaded pin by the force of said spring loaded piston; and g. passing said spring loaded pin through said pinhole opening to puncture said balloon.

11. The method of claim 10, wherein said main body having a shape similar to a revolver with a handle and a muzzle and without a barrel, and said expandable ring being rotatably attachable to said main body adjacent the muzzle.

12. The method of claim 10, wherein said firing mechanism comprises a hammer, a trigger, a pawl, a ratchet wheel, a first spring and a second spring that cooperate and interact with each other as in a revolver, wherein upon actuating said trigger to actuate said firing mechanism, said hammer applies said force to said spring loaded piston.

13. The method of claim 10, wherein said cylinder having a plurality of cylindrical chambers distributed around the axis of said cylinder, and said spring loaded piston is positioned in one of said cylindrical chambers.

14. The method of claim 13, wherein said spring loaded piston comprises a striking element having an extension, a piston element having an opening correspondingly and pivotably connected to said extension, a spring cooperatively connecting said striking element and said piston element, and a coil spring overlaying said piston element, said coil spring interacts with one of said cylindrical chambers to keep said spring loaded piston within said chamber, wherein said force is applied to said striking element of said spring loaded piston by said actuated firing mechanism, and said striking element interacts with said piston element to compress said coil spring to allow said spring loaded piston to exit said chamber in applying said force to said spring loaded pin.

15. The method of claim 10 wherein said expandable ring comprises a non-continuous circular frame member and a frame expander member, said frame member and said frame expander member forming a ring shape.

16. The method of claim 15 wherein said frame member having a first end and a second end, an aperture adjacent said first end and a slot opening adjacent said second end, and said frame expander member having opposite ends, a small opening adjacent each opposite end, and said pinhole opening being positioned between said second end and said slot opening, further comprising the steps of: providing a first fastener connecting said frame expander member to said frame member through one of said small opening and said aperture, and providing a second fastener connecting said frame expander member to said frame member through the other of said small opening and said slot opening.

17. The method of claim 10 wherein said expandable ring further having a hollow tube radially extending from said frame member for receiving said spring loaded pin therein.

18. The method of claim 17 wherein said expandable ring further having a hollow tube having an outer surface with a plurality of depressions, further comprising the steps of: providing a spring loaded plunger having a seat, said seat being springingly pushed against said depressions to allow the indexed rotation of said hollow tube, and indexed rotating said hollow tube of said expandable ring with respect to said main body.

* * * * *